US005237926A

United States Patent [19]

de la Haye

[11] Patent Number: 5,237,926

[45] Date of Patent: Aug. 24, 1993

[54] DROP UNIT WITH IMPROVED RIGHTING CHARACTERISTIC

[75] Inventor: Johannes de la Haye, Kurten, Fed. Rep. of Germany

[73] Assignee: Dynamit Nobel AG Aktiengesellschaft, Troisdorf, Fed. Rep. of Germany

[21] Appl. No.: 793,572

[22] Filed: Nov. 18, 1991

[30] Foreign Application Priority Data

Nov. 22, 1990 [DE] Fed. Rep. of Germany ..... 4037173

[51] Int. Cl.[5] ..... F42B 25/00

[52] U.S. Cl. ..... 102/425; 102/400; 102/401

[58] Field of Search ..... 102/425, 400, 401, 393, 102/489

[56] References Cited

U.S. PATENT DOCUMENTS

| | | | |
|---|---|---|---|
| 952,805 | 3/1910 | Hall et al. | 102/400 |
| 1,330,079 | 2/1920 | Kobuchi | 102/400 |
| 4,922,824 | 5/1990 | Schubart | 102/400 |
| 4,934,274 | 6/1990 | Mathey | 102/401 |
| 4,979,444 | 12/1990 | Schoffl | 102/401 |
| 5,069,136 | 12/1991 | Axelson et al. | 102/425 |

FOREIGN PATENT DOCUMENTS

| | | | |
|---|---|---|---|
| 0285183 | 10/1988 | European Pat. Off. | 102/401 |
| 3127071 | 1/1983 | Fed. Rep. of Germany | 102/401 |
| 3509281 | 9/1986 | Fed. Rep. of Germany | 102/401 |
| 2071271 | 9/1971 | France | 102/401 |
| 9012997 | 11/1990 | PCT Int'l Appl. | 102/401 |

*Primary Examiner*—David H. Brown

*Attorney, Agent, or Firm*—Antonelli, Terry, Stout & Kraus

[57] ABSTRACT

By means of multi-member, spreadable righting assemblies, a supporting area can be enlarged in connection with a rightable drop unit, the torque required for righting can be reduced, and the stability can be enhanced. In order to provide that a base of each righting assembly does perform the desired, defined movement, at least one guide member (for example a parallel guide means) is included. The afore-mentioned improvements can be attained practically without an increase in the volume or in the weight of the drop unit.

18 Claims, 4 Drawing Sheets

4
1
7'
17'
17
7

1
2
20
17
8
21

20
17

21
20
17
d

7'
17'
7
17

9
1
7'
17'
11
8
1

DROP UNIT WITH IMPROVED RIGHTING CHARACTERISTIC

BACKGROUND OF THE INVENTION

This invention relates to a device for positioning a drop unit, especially a mine, after the unit has impinged on the ground, especially a device comprising a plurality of righting assemblies each exhibiting a spreading apart movement that is limited in a final position. A device has been known from DE 1,800,121 C3 which serves to position a drop unit. However, it has been found that droppable units righted in the manner of this disclosure may exhibit inadequate stability in special cases. Drop units placed on uneven terrain can be toppled again by natural (storm) or artificial (clearing measures) occurrences.

BRIEF SUMMARY OF THE INVENTION

The invention is based on the object of increasing the stability of a drop unit, especially a mine, without substantial alterations of the external shape so that storage, transport, and distribution of the drop units can remain essentially unchanged.

This object has been attained according to this invention by a device which limits the spreading movement of each of the righting assemblies.

A characterizing feature of the device according to this invention is provided by the end members of the righting assemblies which, as compared with the known positioning systems, can be spread out and/or splayed in a defined fashion comparatively far remote from the drop unit. A righting assembly is composed of at least two members movably connected to each other. The extreme member, the free end of which serves for providing support on the ground of the terrain, is designated as an end member; whereas, the remaining members of the righting assembly are called intermediate members. The movement of the end member which, an account of the mobility of the members with respect to one another, would initially be indeterminate, is fixed in a defined fashion by one or several guide members. Due to the guide members, only one clearly defined route is possible for any point of the righting assembly, especially also for the free extremity of the end member, in a similar way as in the conventional, single member righting element. It is thus possible in an advantageous way for the righting assemblies of the present invention to rest on the ground of the terrain in the "correct" position and distance with respect to the drop unit, after termination of the spreading step, i.e. in the final position.

In order to enlarge the supporting area of the end members, the end members are preferably provided with a base at their free end, for example in the form of a supporting plate.

The righting assemblies can be of variegated design, the guide members being known from the pantograph-type device or the parallel guide mechanism. The intermediate member and the guide member cannot be distinguished in their function in these special arrangements. The members of the righting assemblies, especially also the end member, extend, in the folded condition, i.e. in the starting position of the righting assemblies, in parallel or approximately in parallel to the essentially cylindrical outer surface of the drop unit. Righting elements with only one intermediate member and one guide member, in addition to the end member, are particularly preferred.

In this connection, it is furthermore preferred to provide only an approximate parallel guidance of the end member by means of the guide member in such a way that the end member, during the splaying process, is additionally also swung obliquely toward the outside so that in the final position the free extremities of the end members of the various righting assemblies are still farther removed from the drop unit than would be the case with a parallel guidance.

The maximum length of the members of a righting assembly is determined by the height of the drop unit and the type of articulation of the righting assemblies at this unit. In case the righting assemblies are articulated to the drop unit in the zone of the end of this unit on the bottom side, it is possible, with a two-membered righting assembly according to this invention with an intermediate member exploiting the maximum length and with an additionally obliquely deployable end member, for the end members to be removed, in their end position, with their free end by almost twice the height of the drop unit from the jacket of the latter, in the lateral direction. If the articulation of the preferably two-membered righting assemblies is arranged approximately in the center of the drop unit, then the members of the righting assembly are correspondingly shorter. The advantage of this "higher level" articulation, however, is an increase in stability, i.e. for toppling the righted drop unit a higher lateral force effect is required.

The articulation of the righting assemblies to the drop unit is preferably effected by way of a universal joint wherein the drop unit is suspended so that it is automatically perpendicularly oriented after the righting step, even in case of uneven ground of the terrain. The length of the end member is to be basically dimensioned so that its free end is located, in the initial position, i.e. in the collapsed condition of the righting assemblies—as seen with the drop unit being arranged in upright position—above the center of gravity of the drop unit. The farther the free end is removed from the center of gravity, the lower is the torque required for righting of the drop unit. In order to yet obtain a maximally large supporting area, i.e. a maximally large lateral distance of the free end of the end member from the drop unit in the final position, the provision can furthermore be made preferably that the end members are extended by elastic, rod-shaped supporting elements of, for example, spring steel.

As a result, at the beginning of the righting process of the drop unit, initially only the rigid section of the end member will become effective, i.e. the end member will be supported on the ground of the terrain with the end of this rigid section located "above" the center of gravity of the drop unit, and the elastically deformable extension of the end member will still rest in a more or less flat fashion on the ground of the terrain. With progressive righting of the drop unit, the spring-elastic extension then also will assume increasingly a straightened shape so that the actually supporting point of the end member will migrate ever farther toward its actual free end. In the final position, the extension has then again assumed a stretched form, as in the initial position.

The expansion movement of the end member in its final position can be limited, for example, by arranging a shape-mating locking means (catch) in this position between the end member and the intermediate member in the region of the rotary joint common to both of them. Another possibility resides in the arrangement of stops at these two members in the region of the pivot joint.

Drive elements are required to place the righting assemblies from their initial position into their end position, i.e. to unfold them, after elapse of a predetermined time period upon impingement of the drop unit on the ground of the terrain. These can be pretensioned springs, especially rotational or torsion springs exerting in at least one pivot a corresponding torque upon the respective member or respective members. However, in addition or in place thereof, it is also possible to provide pyrotechnically activated power elements. The power elements are then preferably located between the diagonally opposed pivots of the preferred, approximate parallel guidance of the members. The power element is preferably of such a design that its piston rod is extended an the compressed gas exposure is made effective on the side of the piston facing away from the piston rod, to achieve a minimal structural size for the power element. Instead of associating each individual power element with a separate pyrotechnical charge generating pressurized gas, it is also possible to arrange a central propellant gas supply by means of a correspondingly larger gas generator.

In another preferred embodiment, each righting assembly is associated with a damping device in order to provide for a more gradual progression of the righting process and thus to maintain dynamic acceleration and deceleration forces at a correspondingly low value.

In this connection, the combination of the damping device with the aforementioned power elements is especially preferred, in that their hollow chamber in the cylinder on the piston rod side contains a fluid, for example oil, which is displaceable in accordance with the principle known from hydraulic shock absorbers during shifting of the piston and the concomitant extension of the piston rod out of the cylindrical housing of the power element.

The particularly preferred device according to this invention exhibits the advantages, in particular, that it can be made in a comparatively lightweight construction since, due to the gradual, damped righting procedure only small dynamic forces occur. Great righting forces can be deployed on account of the use of especially pyrotechnically operated power elements, preferably with a piston rod that can be urged out of the cylindrical housing. Righting is readily possible even in case of a drop unit having a comparatively high center of gravity, wherein this drop unit, with suspension in a universal joint, additionally orients itself after the righting step automatically into an exactly vertical position. Due to the large supporting area with the drop unit in the righted state, a high standing stability is achieved wherein yet the members of the righting assemblies can be comparatively short and accordingly the required stowing length is small.

BRIEF DESCRIPTION OF THE DRAWINGS

The device according to this invention is illustrated schematically in various embodiments in the accompanying drawings and will be described in greater detail with reference thereto. In the drawings.

Figure 1:
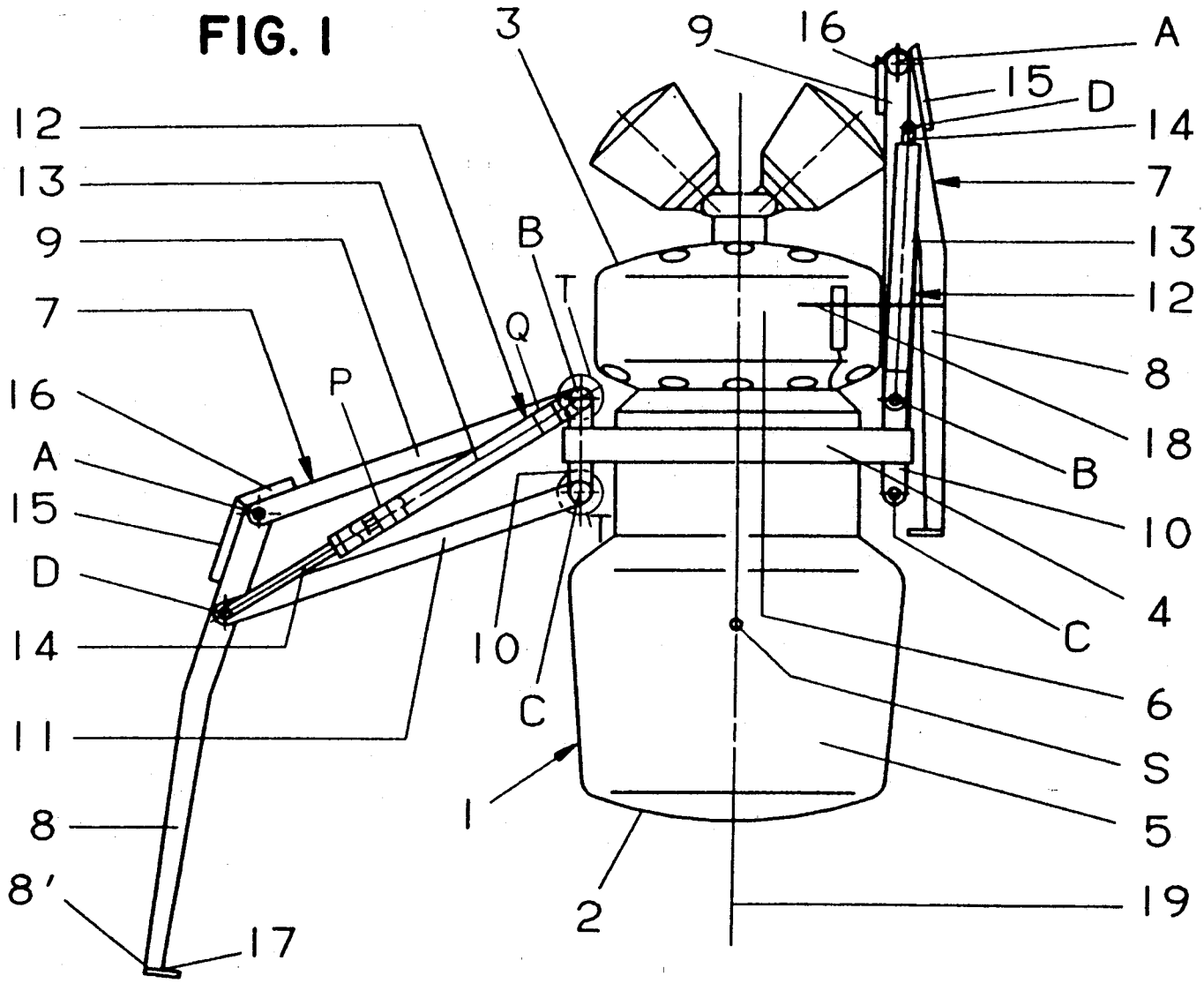
FIG. 1 shows a side view of a drop unit wherein the left-hand half of the figure depicts a righting element in the final position and the right-hand half illustrates a righting element in the initial position.
Figures 2A, 2B, 2C, 2D, 2E, 2F, 2G:
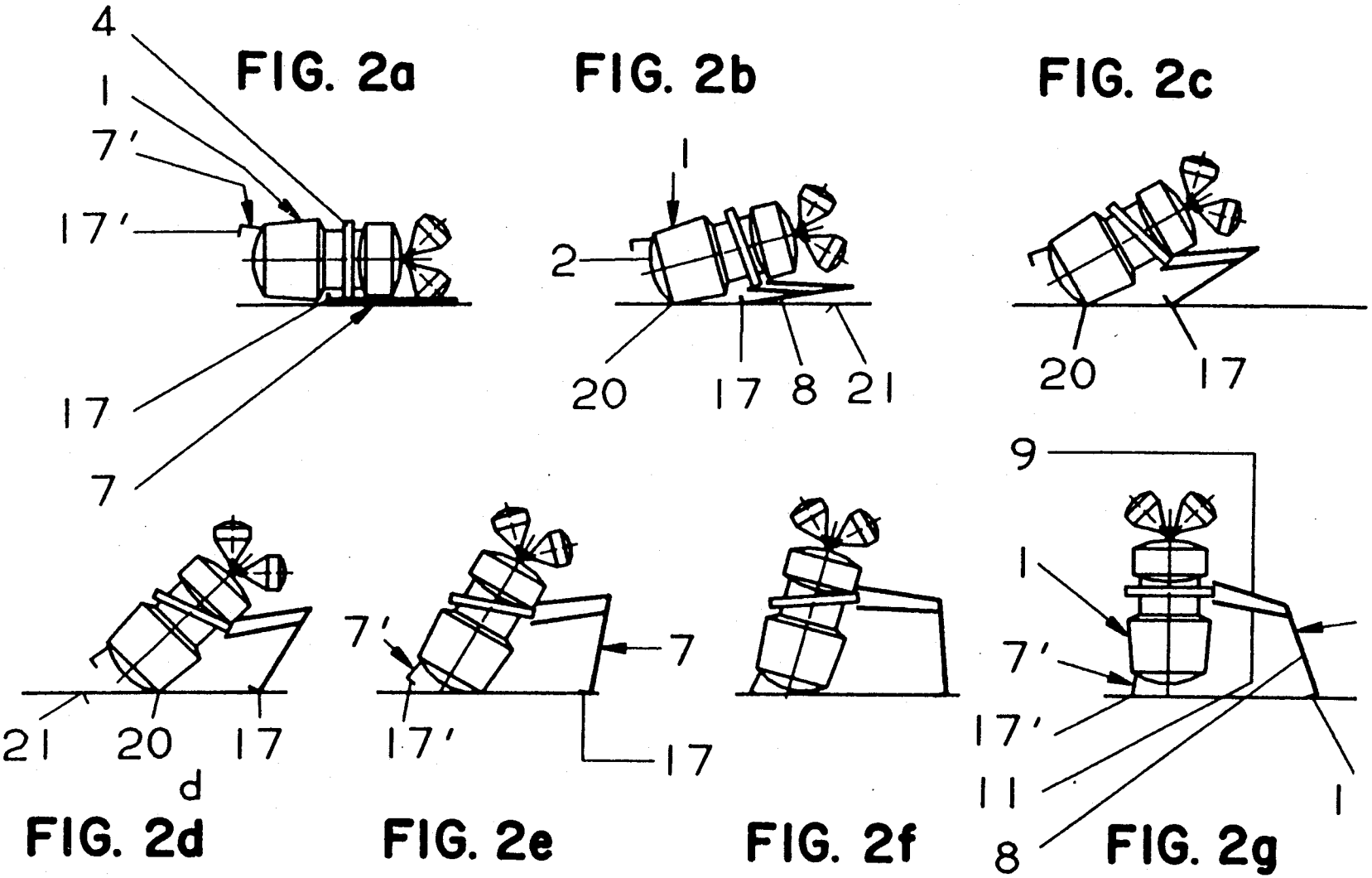
Figure 3:
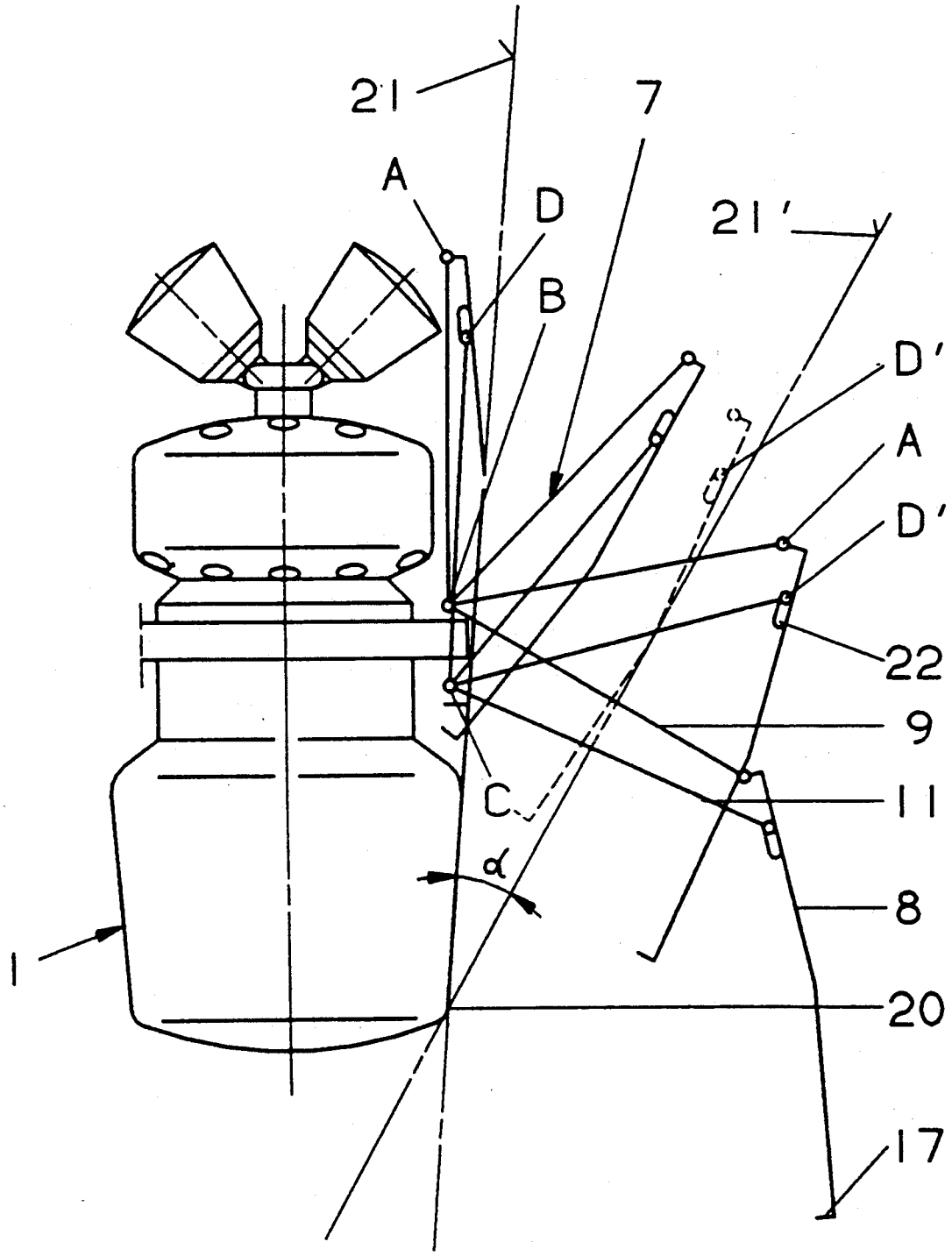
Figure 4:
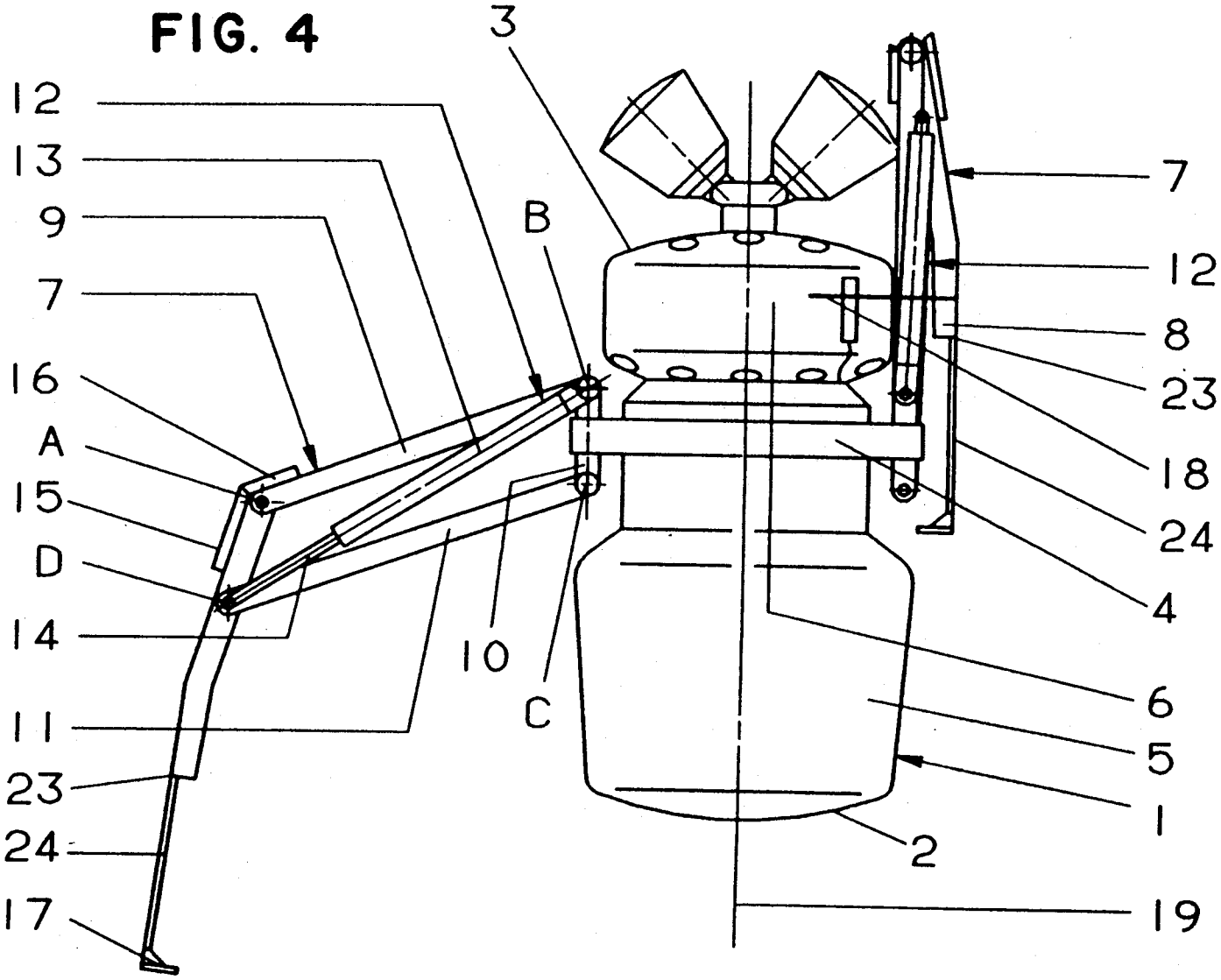

FIG. *2a–2g* depict shows simulation of the righting process or sequence with one righting element;

FIG. 3 shows a side view of the drop unit with a righting element modified as compared with FIG. 1; and FIG. 4 shows a side view of a drop unit with yet another embodiment of a righting element.

DETAILED DESCRIPTION OF THE INVENTION

The drop unit 1 shown in FIG. 1 with an end 2 on the bottom side and an end 3 on the head or top involves a mine exhibiting, as a suspension, a universal joint 4 located above the center of gravity S of the drop unit 1. The mine consists essentially of a mine body 5 with an explosive charge and a rocket engine 6 as the drive mechanism. On the basis of sensor signals characteristic for an object to be combated, the rocket engine is ignited and the mine transported to a height of about 100–300 m. The mine then combats the target from this height. The suspension in the universal joint 4 causes the righted mine to assume a vertical position even in case of uneven ground of the terrain, i.e. it is transportable perfectly vertically in the upward direction.

In order to simplify the illustration, only one righting element or assembly 7 is shown herein of the, for example, five righting assemblies arranged in uniform distribution over the periphery of the drop unit 1; namely in the starting or initial position in the right-hand half of the figure, and in the final position in the left-hand half of the figure. With respect to the illustration in the right-hand half of the figure, it is also to be noted that only an "imagined" position is involved in connection with the drop unit 1, here shown to stand upright, with the righting element 7 in the starting position, since in reality the drop unit 1 with all of the righting assemblies 7 would lie on the ground of the terrain in a more or less horizontal condition in the starting position.

The structure of the righting element or assembly 7 can best be seen in the left-hand half of FIG. 1. The righting assembly 7 comprises an end member 8 and an intermediate member 9. These two members are articulated together at the pivot joint A. A web 10 is vertically attached to the joint 4 and exhibits at its upper end the pivot joint B. To the pivot joint B, the intermediate member 9 is articulated with its end facing away from the pivot joint A. At its lower end, the web 10 has a pivot joint C to which a guide member 11 is articulated with one of its ends. With its other end, the guide member 11 is articulated to the pivot joint D of the end member 8. The spacing between pivot joints A and D—as seen in the vertical direction—is smaller than the spacing between the pivot joints B and C so that here only an intentional, approximate parallel guidance of the articulated-together members is provided. The web 10 could, of course, be omitted if the universal joint 4 had a correspondingly higher dimension, or if the pivot joints B and C were, for example, arranged directly at the outer surface of the housing of the drop unit 1. The end member 8, the intermediate member 9, the web 10, and the guide member 11 are designed herein as inherently rigid elements having essentially the shape of a bar, a rod, a web, or the like.

A pyrotechnically operated power element 12 provided as the drive element for the righting elements 7; this power element is articulated with one of its ends at the pivot joint B and with its other end preferably at the diagonally opposite pivot joint D. The power element 12 comprises the cylindrical housing 13 as well as the piston rod 14. The piston rod 14 can be urged out of the cylindrical housing 13 under the action of a pyrotechnical charge Q which generates pressurized gas and is articulated with its outer free end to the pivot joint D. In order to limit the expansion movement of the end member 8 in the illustrated final position, the stop 15 is provided in the zone of the pivot joint A at the end member 8', and the stop 16 is arranged at the intermediate member 9; these stops come into contact with each other in the final position. The end member 8 carries, at its end 81 facing away from pivot joint A, the base 17 in the form of a supporting plate.

In the right-hand half of the figure, the members 8, 9 and 11 as well as the power element 12 with the piston rod 14 still being within the housing 13 are folded up against the drop unit 1 and held in this initial position by means of a tether strap 18. In this condition, the drop unit is stored and conveyed. After its deployment, it also lies in this state still on the terrain ground for a certain period of time.

After a predetermined time upon impingement on the ground of the terrain, the tether strap 18 is released so that the righting elements 7 can unfold under the action of drive elements, for example pretensioned torsion springs T arranged in pivot joints B and C, in order to finally assume the end position illustrated in the left-hand half of the figure. The drop unit 1 is then disposed upright in ambush position in the terrain.

Insofar as, in accordance with FIG. 1, only the power element 12 is provided as the drive element, the arrangement is to be such that, with the intermediate member 9 being flipped "upwardly" about the pivot joint B and with the end member 8 being flipped "downwardly" about the pivot joint A, the force exerted by the power element 12 on the end member 8 generates a torque about the pivot joints A and B effecting the onset of the unfolding of the members 8 and 9 and finally their transition into the final position. For this purpose, in the starting position, the pivot joint D is laterally somewhat farther removed, in the direction of the unfolding movement, from the longitudinal axis 19 of the drop unit 1 than the pivot joint A. In the functional initiation as described hereinabove, after release of the tether strap 18 and initiation of the pressurized-gas-generating charge Q in the power element 12, the piston P of the power element is activated and thus the piston rod 14 is urged, preferably in a damped fashion, out of the cylindrical housing 13 whereby the end member 8 of the righting element 7, in the starting phase of the splaying movement, is moved laterally toward the outside substantially in parallel to the longitudinal axis 19. The guide member 11 controls, as an approximated parallel guide mechanism, this movement of the end member 8. The aforedescribed suitable choice of the connecting points (pivot joints A, B, C and D) of the individual members has the result that the base 17 of the end member 8 during unfolding is moved somewhat farther away from the longitudinal axis 19 toward the outside than would be expected from the length of the intermediate member 9. In the illustrated embodiment, the end member 8, the intermediate member 9, as well as the guide member 11 are about half as long as the height of the drop unit 1, and yet the objective is achieved in this righting element 7 that the base 17 is almost as far removed from the longitudinal axis 19 as corresponds to the height of the drop unit 1.

The movement of the members is limited in the final position by the stops 15, 16. However, in addition or instead thereof, the provision can be made that the power element 12 is designed conventionally so that its piston and thus also its piston rod 14, after reaching the final position, remain in this position and no longer slide back, in that the piston is, for example, jammed in the housing 13 or enters into a shape-mating connection with the housing in the final position. Furthermore, the power element 12 is preferably provided with a damping means K, for example, in the manner of the hydraulic shock absorbers known from automotive vehicles, so that the unfolding of the righting elements 7 is damped in its dynamics and is chronologically expanded. On account of all these measures, the righting elements 7 can be of a relatively lightweight construction, and a considerable improvement in the standing stability of the drop unit 1 is attained without having to increase its weight for this purpose.

FIG. 2*a*–2*g* respectively show various successive stages of the positioning process of the drop unit 1 in a schematic representation. The reference numerals designate the same elements as in FIG. 1. Here again, for reasons of drawing technique, the righting step is described only with reference to a single righting element 7. Only one further righting element 7' with its base 17' is indicated, namely in such a way as if it had been already fully deployed from the beginning.

The universal joint 4 is mounted at the drop unit 1 in such a way that the center of gravity of the drop unit 1 in the upright condition lies lower than the joint 4. It can be seen that the base 17 of the end member 8 and the bearing point 20 of the rounded end 2 of the drop unit 1 on the ground side, resting on the ground 21 of the terrain, remain locally almost unchanged during the righting procedure in the initial phase, and the actual supporting scope is attained only toward the end of the righting process. It can also be seen from this series that righting of the drop unit 1 is possible in any position in the terrain, and the folded-up righting elements 7, 7' practically do not increase the volume of the drop unit 1.

FIG. 3 shows a drop unit 1 with righting elements 7 modified as compared with those shown in FIG. 1; for simplifying the illustration in the drawing, again only a single righting element 7, among the several elements, is illustrated in a very schematic view. For further simplification, the power element 12 has likewise been omitted, as compared with FIG. 1. The righting element 7 is modified to the effect that the pivot joint D between the end member 8 and the guide member 11 is no longer rigidly fixed during the righting step but rather is shifted during the spreading apart of the end member 8 in a longitudinal guide means 22 formed at the end member 8, in a direction toward the pivot joint A, until this pivot joint D reaches its predetermined final position D' in the longitudinal guide means 22 and is locked therein. The longitudinal guide means 22 could also be replaced, for example, by an eccentric. During the righting of the drop unit 1 from the horizontal, indicated by the line 21 symbolizing the ground of the terrain, the end member 8 remains in contact with the guide member 11 practically until the pivot joint D has attained its end position D' in the longitudinal guide means 22 and is locked therein, but with the rotational mobility being preserved. The drop unit 1 has been righted at this point in time by the angle $\alpha$ with respect to the ground of the terrain, symbolized by the line 21'.

The further positioning procedure then takes place in correspondence with FIG. 1. The advantage of this embodiment of the righting elements 7 resides in that the center of gravity of the drop unit 1 can lie at a higher level, or a smaller torque is required for righting purposes. A similar effect can be obtained if the end member 8 is designed to be very short and is replaced by a telescoping member.

Another embodiment in this connection is illustrated in FIG. 4 wherein the rigid part of the end member 8, under otherwise unchanged conditions, is only half as long as in FIG. 1. An elastic web-shaped supporting element 24 with a base 17*a* adjoins the thus-produced end 23 of the end member 8, so that the end member 8, in total, again attains the length as in FIG. 1. The elastic web-shaped supporting element 24 is made of spring steel, for example. This also achieves the objective that the center of gravity of the righting unit 1 can be at a higher level, or that the torque needed for its righting is smaller. The reference numerals have otherwise the same meanings as in FIG. 1.

What is claimed is:

1. A device for positioning a drop unit after having impinged upon the ground of the terrain, the device comprising:

a plurality of righting assemblies articulated to the drop unit, said righting assemblies being distributed over an outer periphery of the drop unit, said righting assemblies including righting elements extending, in an initial position, in a longitudinal direction of the drop unit;

at least one drive element associated with the respective righting assemblies for spreading said righting elements away from the drop unit after impingement of the drop unit on the ground of the terrain so as to position the drop unit in such a manner that the drop unit faces the ground of the terrain with one end on the bottom and faces away therefrom with another end on a head side, wherein each of said righting assemblies further include an end member and at least one intermediate member, a first pivot joint for articulating the end member to the intermediate member, at least one guide member is provided which, during the spreading of the righting elements results in defining a movement of the end member, and wherein means are provided for limiting the spreading movement of the end member in a final position.

2. A device according to claim 1, wherein each righting assembling is articulated in a zone of a ground-side end of the drop unit, a length of the intermediate member corresponds approximately to a height of the drop unit, and wherein the end member has a length such that the end member terminates, in the initial position, as viewed with the drop unit standing upright, above a center of gravity of the drop unit.

3. A device according to claim 1, wherein each righting assembling is articulated in a central zone between a ground-side end and head-side end of the drop unit, a height of the intermediate member corresponds approximately to half a height of the drop unit, and wherein the end member has a length such that the end member terminates, in the initial position, as viewed with the drop unit standing in an upright position, above a center of gravity of the drop unit.

4. A device according to claim 1, wherein said means for exhibiting includes at least one stop disposed in a region of the first pivot joint.

5. A device according to claim 1, wherein the at least one drive element includes a pretensioned spring.

6. A device according to claim 1, wherein the at least one drive element includes a pyrotechnically activated power element having a cylinder, a piston and an associated piston rod guided in the cylinder.

7. A device according to claim 1, wherein each of the drive elements comprises a cylinder-piston-piston rod unit associated with a central activated gas generator for exposing the pistons to a compressed gas.

8. A device according to claim 1, wherein the drop unit is a mine.

9. A device according to claim 1, wherein the drop unit includes a universal joint located above a center of gravity of the drop unit, each righting assembly is articulated to the universal joint, and wherein the end member has a length such that the end member terminates, as viewed with the drop unit standing upright, above a center of gravity of the drop unit in the initial position.

10. A device according to claim 9, wherein the end member includes a two-part element, said end member being extended beyond an end of one of the parts of the two-part element and beyond a zone of the center of gravity toward the ground-side end of the drop unit, and wherein the other part of the two-part element comprises an elastic supporting element which supporting element, in the final position of the end member, resumes a linearly stretched form as in the initial position.

11. A device according to claim 1, wherein the at least one drive element is associated with a damping means.

12. A device according to claim 11, wherein the damping means comprises a hydraulic shock absorber.

13. A device according to claim 1, wherein the end member, at an end facing away from the first pivot joint, includes a base in the form of one of a disk, plate, or leg, for supporting on the ground of the surrounding terrain.

14. A device according to claim 1 or 13, wherein a second pivot joint is provided for articulating the intermediate member to the drop unit, a third pivot joint is provided for articulating the guide member to the drop unit, and a fourth pivot joint is provided for articulating the guide member to the end member, said pivot joints being arranged such that the intermediate member, and the guide member are displaced in parallel directions during the spreading of the righting assemblies.

15. A device according to one of claims 1 or 13, wherein the end member, the intermediate member and the guide member are coupled to one another in accordance with the principle of pantograph-type device.

16. A device according to claim 15, wherein additional members are coupled to the end member, intermediate member and the guide member.

17. A device according to one of claims 1 or 13, wherein a second pivot joint is provided for articulating the intermediate member to the drop unit, a third pivot joint is provided for articulating the guide member to the drop unit, a fourth pivot joint is provided for articulating the guide member to the end member, and wherein in the final position, the end member, with the end facing away from the first pivot joint, is farther removed from a longitudinal axis of the drop unit than the first pivot joint.

18. A device according to claim 17, wherein an end of the intermediate member facing away from the first pivot joint is articulated to a second pivot joint at the drop unit, and wherein one end of the guide member is articulated at a distance from the second pivot joint in a direction toward a ground-side end of the drop unit to a third pivot joint at said drop unit and, with the other end of the guide member, at a distance from the first pivot joint to fourth at the end member.

* * * * *